US005133266A

United States Patent [19]

Cullen

[11] Patent Number: 5,133,266

[45] Date of Patent: Jul. 28, 1992

[54] PELLET BURNING HEATING DEVICE

[75] Inventor: Leslie D. Cullen, Boise, Id.

[73] Assignee: Mountain Home Development Company, Eagle, Id.

[21] Appl. No.: 778,334

[22] Filed: Oct. 17, 1991

[51] Int. Cl.[5] ..... F23B 7/00

[52] U.S. Cl. ..... 110/233; 110/110; 110/297; 126/58; 126/200

[58] Field of Search ..... 110/233, 110, 314, 297; 126/58, 65, 66, 200

[56] References Cited

U.S. PATENT DOCUMENTS

| | | | |
|---|---|---|---|
| 4,017,254 | 4/1977 | Jones | 110/233 X |
| 4,593,629 | 6/1986 | Pedersen et al. | 110/110 X |
| 4,941,414 | 7/1990 | Carlson | 110/110 X |
| 5,001,993 | 3/1991 | Gramlow | 110/233 |
| 5,070,798 | 12/1991 | Jurgens | 110/110 |

*Primary Examiner*—Edward G. Favors
*Attorney, Agent, or Firm*—Christensen, O'Connor, Johnson & Kindness

[57] ABSTRACT

A pellet burning heating device (20) designed to operate at a combustion efficiency of about 90–98% (based on the carbon derived combustion efficiency formula), and to emit exhaust gases having a carbon monoxide concentration, by volume, of about 0.04% or less, which device does not incorporate a fan system for introducing combustion air into, or extracting exhaust gases from, the stove. High combustion efficiency and clean burning are accomplished by providing a plurality of apertures (130, 132) in the burn pot (120) of the device having a predetermined size, number, and placement. More specifically, the total area of the apertures in the bottom wall (122) and portions of the sidewall (124) at or below the pellet level (134) in the burn pot is equal to the total area of the apertures in the sidewall positioned above the pellet level. The pellet level refers to the position of the top surface of the pellets positioned in the burn pot when the device is coupled with a chimney having a predetermined draft and when pellets are fed into the burn pot at a predetermined feed rate.

17 Claims, 3 Drawing Sheets

PELLET BURNING HEATING DEVICE

FIELD OF THE INVENTION

The present invention relates to pellet burning heating devices, e.g., stoves, and more particularly to means for controlling the introduction of combustion air to pellet burning heating devices so as to minimize the quantity of hazardous substances in the exhaust gases of the device and maximize the combustion efficiency of the device.

BACKGROUND OF THE INVENTION

Pellet burning stoves of the type disclosed in U.S. Pat. Nos. 4,619,209, 4,669,396, and 4,779,544 have become very popular in recent years due to their low emission levels, high combustion efficiency, and ease of operation. Such stoves typically comprise a combustion chamber, a burn pot coupled with the combustion chamber for supporting pellets during the combustion process, a hopper for storing pellets, and an auger assembly for transporting pellets from the hopper to the burn pot. The burn pot of pellet burning stoves of the type disclosed in the patents identified above typically comprises a plurality of holes extending through the sidewall of the burn pot through which combustion air is introduced to the pot.

In an attempt to improve the combustion efficiency and reduce the quantity of harmful gases emitted from pellet stoves, fan systems have been added to such stoves to force combustion air into the burn pot or to draw exhaust gases out of the combustion chamber. Indeed, it is believed that all pellet stoves currently marketed in the United States which are designed to emit exhaust gases having a carbon monoxide concentration, by volume, of less than 0.04% utilize a fan system for forcing air into, or drawing gases out of, the stove. Because the speed of the fan must be automatically varied based on the desired heat output, the actual burn rate, and other factors to ensure clean burning and high combustion efficiency, a microprocessor-controlled fan adjustment system is required. For instance, the clean burning commercial embodiment of the pellet stove disclosed in U.S. Pat. No. 4,779,544, i.e., the embodiment designed to emit exhaust gases having at CO levels of less than 0.04%, uses an exhaust fan to extract exhaust gases from the stove. Although the '544 patent is silent regarding the manner in which exhaust gases are withdrawn from the stove, the construction of the stove is such that an exhaust fan is believed to be required to achieve clean burning, as evidenced by the use of an exhaust fan on the commercial embodiment of the stove of the '544 patent (the Welenco Pellet Heater manufactured by Welenco Mfg. Inc., Lewiston, Id.).

The use of one or more fans and an associated control system typically adds about $200 to $300 to the retail cost of such a stove. Additionally, although the control system can be shielded to some extent from the high temperatures adjacent the stove, in practice the service life of the printed circuit board and other components of the fan control system is often reduced to an unacceptably short period as a consequence of the high temperature environment in which the control system must operate.

To ensure a pellet stove burns as cleanly as possible, the quantity of combustion air introduced into the burn pot through the apertures in the sidewall thereof must be carefully controlled. In pellet stoves designed to emit exhaust gases having CO concentrations of less than 0.04%, delivery of the proper quantity of combustion air is typically achieved by appropriate operation of the fan system for introducing combustion air into, or withdrawing exhaust gases from the stove. Because delivery of a proper quantity of combustion air is virtually ensured if appropriately sized fans are used and if the microprocessor of the fan control system is correctly programmed, the size, number and placement of the apertures in the sidewall of the burn pot through which combustion air is introduced are not critical to the clean burning operation of the stove. As a consequence, it is believed that little research has been conducted regarding the size, number and placement of the combustion air intake apertures in the burn pots of pellet burning stoves required to achieve optimal combustion efficiency and minimal emissions of harmful exhaust gases.

Recently, carbon monoxide concentration in stove exhaust gases has become regarded by many as the preferred indicator of overall cleanliness of stove exhaust, with CO levels below 0.04% being achieved only by the cleaner-burning pellet stoves. A carbon monoxide concentration of 0.04% correlates closely with a particulate count of about 7 grams per hour, the current EPA standard for wood stoves not equipped with a catalytic converter. Particulate count is the older, and many feel the less accurate, technique for determining combustion efficiency of a stove.

SUMMARY OF THE INVENTION

The present invention is a pellet burning heating device which is designed to emit exhaust gases having a carbon monoxide concentration, by volume, of less than 0.04% and which does not use a fan system for introducing combustion air into, or extracting exhaust gases from, the device.

More specifically, the present invention is a pellet burning heating device designed to be coupled with a chimney having a predetermined natural draft, the device comprising a housing having a combustion chamber, a burn pot coupled with the combustion chamber and having a plurality of selectively sized and positioned apertures extending through the bottom and sidewall thereof, and a feed assembly for feeding pellets into the burn pot. The housing has a first aperture through which exhaust gases may escape from the combustion chamber and a second aperture through which combustion gases may enter the combustion chamber. The burn pot is attached to the housing so that its hollow interior is in communication with the combustion chamber via the second aperture in the housing. The feed assembly is designed to dispense pellets into the interior of the burn pot at a selected rate such that a predetermined quantity of pellets is maintained in the interior, i.e., so that the pellet level remains substantially constant.

The size, number, and placement of the apertures in the bottom and sidewall of the burn pot are selected, i.e., the burn pot is "tuned", to ensure that the quantity and mixture of primary and secondary combustion air which flows through the apertures into the burn pot is such that clean-burning operation is maintained without the need for a fan system for introducing combustion air into, or extracting exhaust gases from, the stove. Such clean-burning operation is achieved by providing a plurality of apertures in the bottom of the burn pot and in the portions of the sidewall of the burn pot below the pellet level, which apertures have a total cross-sectional area which is about equal to or less than the total cross-sectional area of the apertures provided in the portions of the sidewall above the pellet level. As noted above, the pellet level in the burn pot is maintained at a substantially constant position by the pellet feed assembly. As a consequence of this design, combustion air flows into the interior of the burn pot solely by natural convection and exhaust gases are withdrawn from the combustion chamber solely by the natural draft of a chimney coupled with the heating device. At the same time, exhaust gases emitted by the device have a CO content of less than 0.04%, with the CO content more typically being in the 0.01–0.02% range.

DETAILED DESCRIPTION OF THE INVENTION

Figure 1:
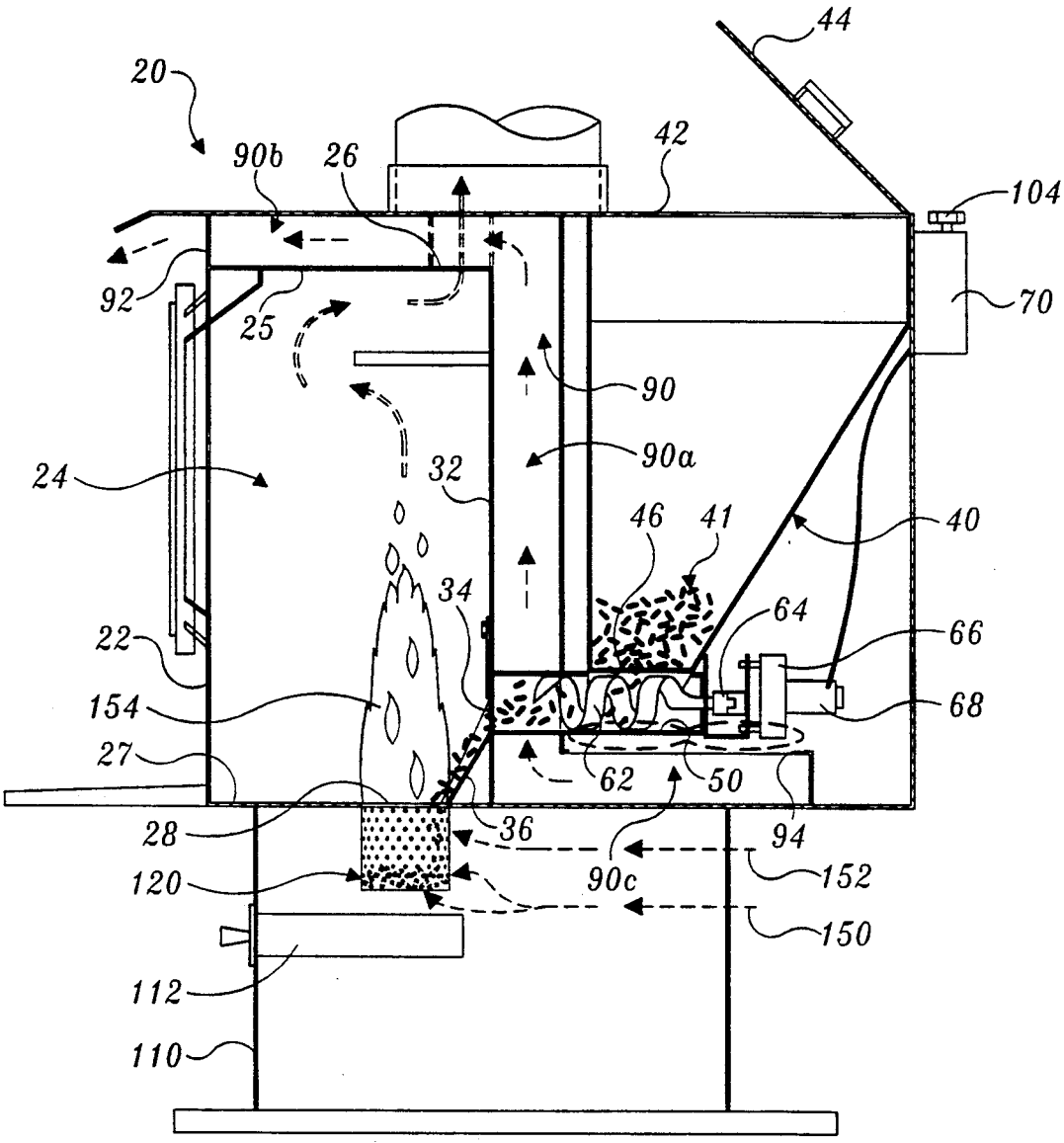
FIG. 1 is a cross-sectional side elevational view of the heating device of the present invention.
Figure 2:
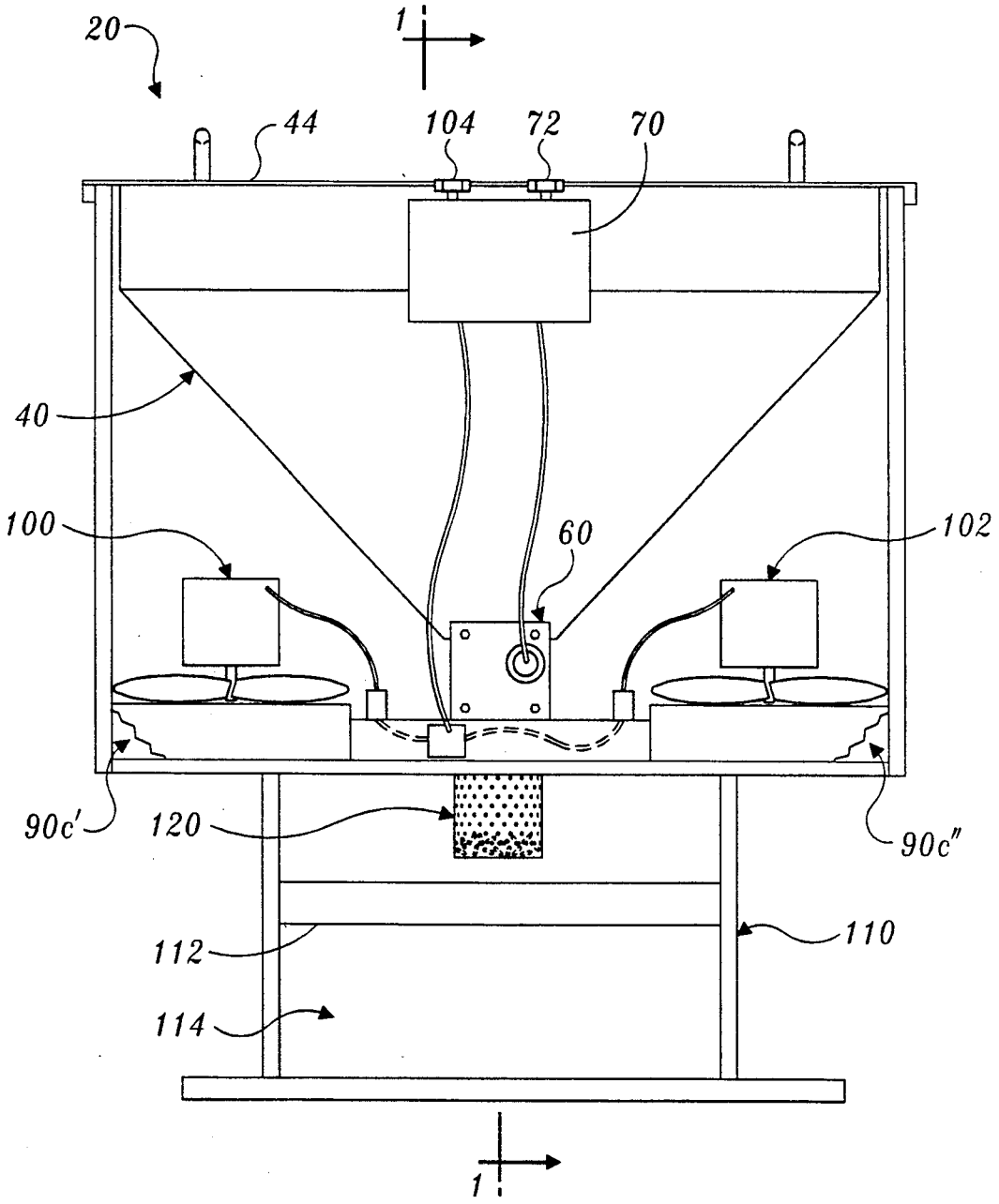
FIG. 2 is a rear elevational of the device illustrated in FIG. 1.

Referring to FIGS. 1 and 2, the present invention is a pellet burning heating device 20 which is designed so that combustion air is introduced solely by natural convection and exhaust gases are withdrawn solely by the natural draft of the chimney with which the device is coupled. Furthermore, as a consequence of the design of the heating device 20, the exhaust gases emitted from the device have a carbon monoxide ("CO") concentration, by volume, of 0.04% or less.

Heating device 20 is illustrated in the FIGURES and described herein as a pellet burning stove. However, as those of ordinary skill in the art will appreciate, the design and principles of operation of device 20 may be incorporated in a furnace, boiler, hot water heater, and other heating devices.

Device 20 comprises a housing 21 having a front door 22 with a window 23 positioned therein. Housing 21 includes combustion chamber 24 in which a significant portion of the combustion of the wood gases driven off by the initial burning of the pellets occurs, as discussed in more detail below. Housing 21 comprises a ceiling 25 having an aperture 26 through which exhaust gases pass out of combustion chamber 24, and a floor 27 having a bottom aperture 28 through which combustion air and wood gases are introduced into the combustion chamber, also as described in more detail below. Housing 21 also comprises a front wall 29 having a door opening 30 provided therein. Opening 30 is sized and positioned so that combustion chamber 24 may be viewed through window 23 in door 22 and opening 30. Housing 21 also includes a rear wall 32 having a feed opening 34 near the bottom end thereof, and opposing sidewalls, one of which is identified at 35 in FIG. 1. A chute 36 is preferably provided, extending between feed opening 34 and aperture 28, for transporting pellets dispensed from opening 34 to aperture 28, as discussed in more detail below.

Housing 21 also includes a plate 37 attached to sidewalls 35 and ceiling 25 adjacent the junction of the ceiling and the front wall 30 so as to extend horizontally across the entire width of combustion chamber 24. Plate 37 is sized and positioned so as to enclose and define, together with adjacent portions of front wall 30 and ceiling 25, an air passageway 38 extending across the entire width of combustion chamber 24 and terminating at the sidewalls of stove 20. Plate 37 extends through opening 30 in front wall 29 and terminates near, i.e., about 0.5 inch inwardly of the inner surface of window 23. Two apertures are provided in the sidewalls of housing 22, the one in sidewall 35 being identified at 39 in FIG. 1. Apertures 39 are positioned so as to intersect passageway 38, whereby outside air may pass into the passageway.

Plate 37, the passageway 38 enclosed thereby, and apertures 39 are provided to supply a wash of cool air to window 23 in door 22. More specifically, during the operation of device 20, relatively cool air passes through apertures 39 into passageway 38, travels along the passageway and spills out along the outermost part of plate 37 onto the inner surface of window 23. This cool air wash prevents carbon deposits from building up on the inner surface of window 23, thereby permitting the viewing of the fire within combustion chamber 24.

To ensure that stove 20 burns cleanly and efficiently, it is important that apertures 39 be relatively small. In one embodiment of the present invention each aperture 39 had a diameter of about 0.25 inch. If apertures 39 are too large, the quantity of outside air entering combustion chamber 24 will be such that CO levels will climb to unacceptably high levels. On the other hand, if apertures 39 are too small, then the quantity of air delivered via passageway 38 will be insufficient to prevent the deposition of carbon on the inner surface of window 23.

Device 20 also includes a pellet hopper 40 for storing a predetermined quantity of the pellets 41 to be burned in the device 20. In one embodiment, hopper 40 is sized to store about 50 pounds of conventional pellets, i.e., pellets of the type identified by the label "APFI" (American Pellet Fuel Institute). Hopper 40 comprises a top opening 42 through which pellets may be added to the hopper. A door 44 is provided for closing off opening 42. Hopper 40 additionally comprises a bottom opening 46 through which pellets contained in hopper 40 will be drawn, under the pull of gravity, into feed chamber 50. Feed chamber 50 extends between the bottom opening 46 in hopper 40 and feed opening 34 in rear wall 32, whereby a continuous passageway is provided between bottom opening 46 and feed opening 34.

Device 20 additionally comprises a feed mechanism 60 for urging pellets which have traveled from hopper 40 into feed chamber 50 out of the latter, through feed opening 34 in rear wall 32, down chute 36, through combustion air aperture 28, and into burn pot 120, the latter being described in more detail hereinafter. Feed mechanism 60 comprises an auger 62 positioned in feed chamber 50, a universal joint 64 attached to the rear end of the auger, a gear reduction box 66 coupled to the rear end of universal joint 64, and a motor 68 coupled to gear reduction box 66. Motor 68 is coupled with a speed control device 70 which comprises a speed control mechanism (not shown), such as a potentiometer, which is operated by appropriate manipulation of a knob 72 (FIG. 2) coupled therewith. The various components of feed mechanism 60 are preferably designed so that the weight of pellets 41 dispensed by the feed mechanism through feed opening 34 ranges from 0.75 pounds per hour to 6 pounds per hour, depending upon the rotational setting of knob 72. Slower or faster feed rates may be achieved by appropriate design of feed mechanism 60 and speed control device 70.

Device 20 further includes a convection system for causing room temperature air to enter and move within device 20 so as to be heated by the high temperature gases present in combustion chamber 24 and then be exhausted into the room in which device 20 is positioned. This convection system comprises a convection chamber 90 (FIG. 1) comprising a central portion 90*a* positioned between housing 21 and hopper 40 so as to confront the back surface of rear wall 32 of housing 21 and to be spaced slightly from the front wall of hopper 40. Convection chamber 90 also comprises an upper portion 90*b* which is coupled with the upper end of central portion 90*a*, and confronts and extends along the upper surface of ceiling 25 of housing 21. Upper portion 90*b* terminates in an opening 92 through which heated air present in upper portion 90*b* may be exhausted from the latter. Central chamber 90 also comprises a bottom portion 90*c* coupled with the bottom end of central portion 90*a* and positioned so as to extend rearwardly therefrom. As best illustrated in FIG. 2, lower portion 90*c* is bifurcated with portion 90*c'* being positioned to the left of feed assembly 60, and right portion 90*c''* being positioned to the right of feed mechanism 60. Right portion 90*c''* comprises an opening 94 (FIG. 1) through which room temperature air may be introduced into this portion of the convection chamber 90. A similar opening (not shown) is provided in left portion 90*c'*.

The convection system of device 20 further comprises fans 100 and 102 which are positioned above left portion 90*c'* and right portion 90*c''*, respectively. Fans 100 and 102 are provided for forcing room temperature air through openings 94 in left and right portions 90*c'* and 90*c''* so as to cause such air to move through lower portion 90*c*, up through central portion 90*a*, through upper portion 90*b*, and out of the upper portion through opening 92. As the room temperature air introduced into lower portion 90*c* by fans 100 and 102 travels upwardly through central portion 90*a*, heat present in combustion chamber 24 is conducted through rear wall 32 of housing 21 so as to heat the air as it passes through the central portion. Additional heating of this air occurs as it travels through an upper portion 90*b* prior to its discharge through opening 92.

Fans 100 and 102 are also coupled with speed control device 70. The latter comprises a second speed control mechanism (not shown) for adjusting the operating speed of fans 100 and 102. The operation of this second speed control mechanism is controlled by appropriate manipulation of a knob 104 which is mounted adjacent knob 72 on the upper surface of speed control device 70.

The convection system of device 20 described above constitutes an effective mechanism for transferring heat generated as a consequence of the pellet combustion process into the room in which the stove is located. However, it is to be appreciated that the chamber 90 and fans 100 and 102 are not required. Indeed, highly effective heat transfer from device 20 into the room in which the stove is located occurs by conduction alone.

The convection system of device 20 does not urge combustion air into combustion chamber 24 or extract exhaust gases from the combustion chamber. As discussed in more detail below, such introduction and extraction is accomplished solely by natural convection forces.

The components of device 20 described above, i.e., housing 21, hopper 40, feed chamber 50, feed mechanism 60, and convection chamber 90, are all supported on a pedestal 110. The latter is designed to support these components a selected distance, e.g., about 18 inches, above the surface on which device 20 is positioned. Pedestal 110 includes an ash drawer 112 positioned beneath burn pot 120, and a rear opening 114 (FIG. 2) through which combustion air traveling to burn pot 120 may pass.

Referring now to FIGS. 1–4, device 20 further comprises a burn pot 120 for supporting pellets during the combustion thereof. Burn pot 120 comprises a bottom wall 122 (FIG. 4) and a sidewall 124 (FIG. 3) which is attached to the bottom wall. Together, bottom wall 122 and sidewall 124 enclose and define the interior 126 of the burn pot. The upper end of burn pot 120 is open, and an annular flange 128 is attached to the uppermost portion of sidewall 124 so as to extend radially outwardly therefrom. Flange 128 is provided for securing burn pot 120 to floor 27 such that an air tight seal is achieved between the upper end of the burn pot and floor 27 and so that interior 126 of the burn pot is aligned with combustion air aperture 28 in floor 30. As a consequence of this attachment of burn pot 120 to floor 130, interior 126 of the burn pot is in direct communication with combustion chamber 24 of housing 21 via combustion air aperture 28. The size and configuration of air aperture 28 is selected so as to be similar, if not identical to the size and cross-sectional configuration of interior 126 of burn pot 120.

Figure 3:
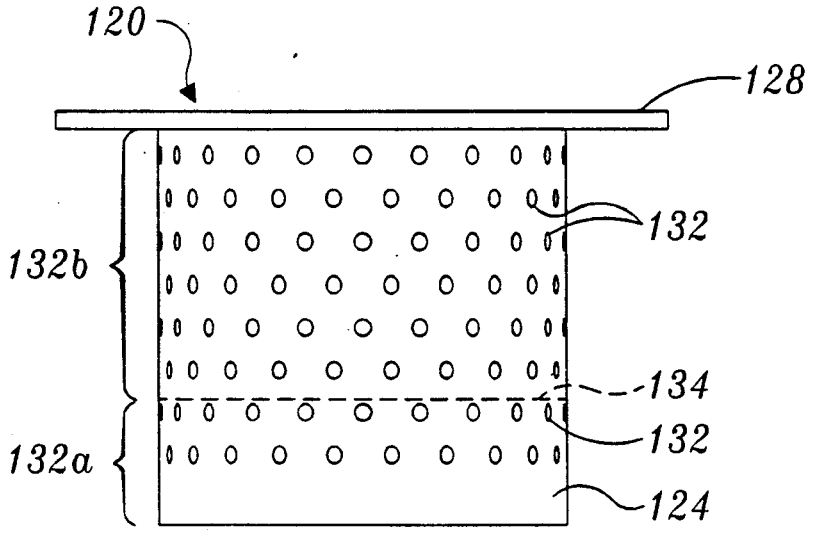
FIG. 3 is a side elevational of one embodiment of the burn pot of the device illustrated in FIG. 1.
Figure 4:
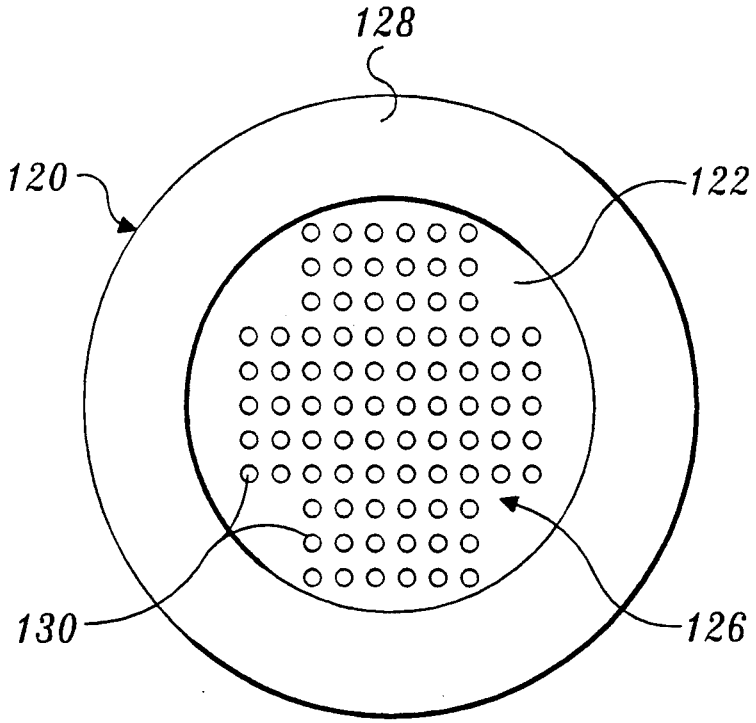
FIG. 4 is a top elevational view of the burn pot illustrated in FIG. 3.

Burn pot 120 includes a plurality of apertures 130 (FIG. 4) extending through bottom wall 122, and a second plurality of apertures 132 (FIG. 3) extending through sidewall 124. The size, number, and placement of apertures 130 and 132 are selected so that the total cross-sectional area of apertures 130 and those apertures 132 positioned at or below pellet level 134 (the latter being illustrated in FIG. 3 and described in greater detail hereinafter), i.e., apertures 132*a* as illustrated in FIG. 3, is less than or about equal to, preferably about equal to, the total cross-sectional area of those apertures 132 positioned above pellet level 134, i.e., apertures 132*b* as illustrated in FIG. 3. Preferably, apertures 130 are evenly spaced in a regular pattern in bottom wall 122, and apertures 132 are evenly spaced within parallel, evenly spaced rows in sidewall 124. As discussed in greater detail below, primary combustion air is introduced through apertures 130 and 132*a*, and secondary combustion air is introduced through apertures 132*b*.

Pellet level 134 represents the level of the top surface of the pellets positioned in burn pot 120(*a*) when device 20 is connected with a chimney (not shown) having a draft sufficient to permit device 20 to operate at maximum combustion efficiency and to maintain emission levels below 0.04% and (*b*) when feed mechanism 60 is operated at its highest rate of feed. As used herein, the "highest rate of feed" or "maximum feed rate" means the fastest feed rate at which the natural draft of the chimney coupled with device 20 is capable of supporting combustion such that pellets are burned at substantially the same rate at which they are fed. This definition assumes that an unlimited quantity of combustion air is freely available to the burning pellets. Thus, for a chimney having a 3-inch diameter circular flue and a draft length of 12 feet, the combustion of pellets fed at perhaps 4 pounds per hour could be supported by the natural draft of such chimney. Similarly, for a chimney having a 6-inch diameter circular flue and a draft height of 15 feet, the combustion of pellets fed at perhaps 6 pounds per hour could be supported by the natural draft of such chimney. Thus, the maximum feed rate for a given device 20 will vary as a function of the natural draft of the chimney with which the device is coupled. In practice, under the conditions set forth in the first sentence of this paragraph, there is a slight cyclical variation of pellet level 134. The highest pellet level in the cycle remains below or even with bottommost ones of apertures 132*b* through which secondary combustion air is introduced into burn pot 120, and the lowest pellet level in the cycle may reach a level just below the uppermost ones of apertures 132*a* through which primary combustion air is introduced into burn pot 120.

This cyclical variation in pellet level 134 is believed to be caused by naturally occurring changes in the burn rate of the pellets in pot 120. When pellet level 134 is at its highest level, a relatively large quantity of pellets is burning, with the result that a relatively large amount of heat is generated, thereby causing the draft in the chimney coupled with device 20 to increase. This increase in draft causes more air to be drawn into burn pot 120 through apertures 130 and 132, causing the fire to burn even hotter, with the result that the rate of combustion increases and the pellet level drops slightly. When the pellet level drops, the rate of combustion decreases because fewer pellets are available for burning, with the result that less heat is generated, thereby reducing the draft in the chimney coupled with device 20. Because feed mechanism 60 continues to supply pellets at a substantially constant rate, the pellet level soon rises again to the upper limit in the cycle. The rate of combustion then increases, thereby repeating the cycle discussed above. A complete cycle of this variation in pellet level occurs over a relatively short period of time, e.g., about 1 to 2 minutes, with the change in pellet depth being less than about 0.50 inch. As used herein, pellet level 134 means the average pellet level within the narrow range of variation in pellet level discussed above.

Of course, when pellets are fed at less than the maximum feed rate, pellet level 134 will drop below the level illustrated in FIG. 3.

When burn pot 120 is constructed so that the total cross-sectional area of the apertures above pellet level 134 is about equal to the total cross-sectional area of the apertures below pellet level 134, the latter being defined as the level at which pellets in burn pot 120 are maintained when feed mechanism 60 is operated at a maximum feed rate, CO levels below 0.04% and maximum combustion efficiency are achieved only when the chimney with which the device is coupled has an appropriate draft. Although the specific flow rate of the draft required to optimize CO emissions and combustion efficiency will vary as a function of the combined cross-sectional area of the primary and secondary apertures, for a given draft, CO emissions and combustion efficiency are optimized when the primary and secondary apertures together have a specific cross-sectional area. The dimensions of this specific cross-sectional area may be obtained by trial and error for a given chimney, by varying aperture number and/or size until maximum combustion efficiency and minimum CO emission levels are obtained. One set of such dimensions is set forth below in connection with the description of the exemplary embodiment of the invention. However, combustion efficiency in the 90–98% range (based on a carbon derived combustion efficiency formula) with CO levels in the 0.01–0.02% range is readily obtainable with the present invention.

Thus, burn pot 120 must be "tuned" for the chimney with which device 20 is to be coupled. As a corollary to this relationship, for a burn pot having primary and secondary apertures which together have a given cross-sectional area, optimum CO levels and combustion efficiency may be obtained by varying the height of the chimney with which device 20 is coupled until combustion efficiency is maximized and CO emissions levels consistently remain below 0.04%.

Tests of device 20 indicate that (a) when feed mechanism 60 is operated at a maximum feed rate, (b) the total cross-sectional area of the apertures in burn pot 120 above the pellet level is about equal to the total cross-sectional area of the apertures in the burn pot below such pellet level, and (c) the draft of the chimney with which device 20 is coupled is such that maximum combustion efficiency is achieved and CO emissions levels consistently remain below 0.04%, then the volume of secondary combustion air entering interior 126 of burn pot 120 through the apertures positioned above the pellet level, during a selected time interval, is about four times the volume of primary combustion air entering interior 126 through the apertures positioned below the pellet level during the same time interval. This four-to-one volume relationship may be used by those practicing the present invention in selecting the appropriate number and size of apertures in burn pot 120 for a given chimney, or the appropriate chimney height for a given burn pot. Tests additionally suggest that under the operating conditions set forth in the first sentence of this paragraph, the ratio of the total cross-sectional area of apertures above the pellet level to the total cross-sectional area of apertures below the pellet level can be varied only a slight amount if optional combustion efficiency and CO levels below 0.04% are to be maintained. More specifically, it is believed that under the above-described operating conditions, optimal combustion efficiency and CO levels below 0.04% may be maintained only when the total cross-sectional area of the apertures above the pellet level ranges from about 95–110% of the total cross-sectional area of the apertures below the pellet level. Relatedly, under the above-described operating conditions, maximum combustion efficiency and CO levels below 0.04% are maintained only when the volume of air flowing through the apertures above the pellet level during any selected period of time ranges from about 3.9 to 4.2 times the volume of air flowing through the apertures below the pellet level during the selected period of time.

However, it should be appreciated that when pellets are fed at the maximum feed rate the pellet level may temporarily rise above some of the bottom row of secondary combustion apertures 132*b*, thereby causing the total cross-sectional area of secondary apertures to drop below the 95% level identified above. Because such rise in pellet level causes the rate of combustion of device 20 to rapidly increase, the pellets will drop back to pellet level 134 before CO emissions have a chance to rise above the 0.04% level. Thus, although under steady-state operating conditions the total cross-sectional area of secondary combustion apertures should be at least 95% of the total cross-sectional area of primary combustion apertures, device 20 will accommodate temporary deviation from this ratio without increase in CO levels above 0.04%.

When feed mechanism 60 is operated at less than the maximum feed rate, thereby causing the pellet level to drop, the total cross-sectional area of the apertures in burn pot 120 above the new pellet level becomes greater than the total cross-sectional area of the apertures below the pellet level. Test results indicate that CO levels remain below 0.04% at such lower feed rates, although combustion efficiency typically drops below the level obtained when feed mechanism 60 is operated at the maximum feed rate. These test results were obtained when device 20 was coupled with a chimney having a draft such that maximum combustion efficiency and CO levels below 0.04% were obtained when feed mechanism 60 was operated at a maximum feed rate. In fact, CO levels below 0.04% may be maintained with device 60, even when the pellet level drops to a point where the total cross-sectional area of the apertures through which primary combustion air is provided is significantly greater than, e.g., 20 to 30 times greater than, the cross-sectional area of the apertures through which secondary combustion air is provided. Relatedly, at lower feed rates, the volume of air introduced through the apertures in burn pot 120 above the pellet level during a given time interval is about 20 to 30 times the volume of air introduced through the apertures below the pellet level, when CO levels below 0.04% are maintained.

Thus, the requirement that the total cross-sectional area of the apertures above the pellet level be about equal to the total cross-sectional area of the apertures below the pellet level applies only when feed mechanism 60 is operated at a maximum feed rate and when device 20 is coupled with a chimney having a draft such that combustion efficiency of the device is optimized and CO levels remain below 0.04%. When device 20 is constructed to satisfy the low CO emissions/high combustion efficiency requirements at maximum feed rates, CO levels below 0.04% are maintained at lower feed rates even when the total cross-sectional area of apertures above the pellet level is greater than the total cross-sectional area of apertures below the pellet level.

From the preceding discussion it may be appreciated that burn pot 120 is tuned for the chimney with which it is designed to be coupled by operating feed mechanism 60 at a maximum feed rate and then adding apertures in equal number above and below the pellet level until combustion efficiency is maximized and CO levels are typically in the 0.01–0.02% range, and always below 0.04%. If the total cross-sectional area of the apertures above and below the pellet level is decreased below the cross-sectional area at which combustion efficiency is maximized and CO levels remain in the 0.01–0.02% range by more than a relatively small amount, e.g., 20%, then CO emissions typically rise above the 0.04% level. Thus, the total cross-sectional area of the apertures in burn pot 120 must be carefully selected to optimize the performance of device 20.

In operation, primary combustion air, identified at 150 in FIG. 1, enters interior 126 of burn pot 120 through apertures 130 in bottom wall 122 and through the apertures 132 in sidewall 124 positioned below pellet level 134. Secondary combustion air, identified at 152 in FIG. 1, enters interior 126 through those apertures 132 positioned above pellet level 134. Both primary and secondary combustion air travels solely by natural convection through rear opening 114 in pedestal 110 and into and through apertures 130 and 132. Primary combustion air is used in the initial combustion of the pellets in burn pot 120. This initial combustion results in gasification of the wood, and some combustion of the gases thus produced. Additional combustion of such wood gases is supported by the secondary combustion air. Because the combustion air and wood gases flow up through aperture 28 in floor 27, through combustion chamber 24, and out aperture 26 in ceiling 25, combustion of the gases driven off from the wood generally appears as a column of fire 154 (FIG. 1) extending upwardly from burn pot 120.

Exemplary Embodiment

As those of ordinary skill in the art will appreciate, the specific size, number, and placement of apertures 130 and 132, as well as the shape and configuration of burn pot 120, will vary as a function of the desired heat output of device 20, the draft of the chimney with which device 20 is coupled, and the feed rate of feed mechanism 60. However, in one embodiment of the present invention, (a) in which heating device 20 consists of a stove designed to provide a maximum heat output of about 38,000 BTUs per hour, (b) the stove is designed to be coupled with a chimney having (i) a draft height of 12 feet (as measured from the surface on which the stove is positioned) and (ii) a flue with a circular cross section about six inches in diameter, and (c) includes a feed mechanism 60 having a maximum feed rate of about 6 pounds of APFI pellets per hour, burn pot 120 has a cylindrical configuration, and its interior 126 is about 3.5 inches deep and 3.0 inches in diameter. Furthermore, apertures 130 consist of 86 circular openings in bottom wall 122, each having a diameter of 0.125 inch, with the holes being evenly spaced within a cross pattern comprisng two legs which extend in right angle relation, each across substantially an entire diameter of bottom wall 122. Also in this embodiment, apertures 132 consist of 176 circular holes, each having a diameter of about 0.125 inch. Preferably, the holes are arranged in 8 horizontal rows of 22 holes each, with the holes being evenly spaced within the rows, and the rows being evenly spaced so as to extend over substantially the entire vertical length of sidewall 124. The rows of holes are additionally spaced so that two rows are positioned below pellet level 134 and 6 rows are positioned above pellet level 134. As a consequence of this placement of apertures 130 and 132, one hundred and thirty (130) apertures are provided in bottom wall 120 and the portion of sidewall 124 positioned below pellet level 134, and one hundred and thirty-two (132) apertures are positioned above pellet level 134. Thus, the total cross-sectional area of the apertures positioned below pellet level 134 is substantially equal to the total cross-sectional area of the apertures positioned above pellet level 134. It has been determined that with respect to the embodiment of device 20 described above, the volume of air introduced into interior 126 of burn pot 120 above pellet level 134 is, during a given time interval, about four times the volume of air which is introduced into interior 126 below pellet level 134, during the given time interval.

Exhaust gases emitted by the stove 20 described in the preceding paragraph, when the stove was coupled with a chimney having a 12-foot draft height and a circular flue with a diameter of 6 inches, and when feed mechanism 60 was operated so as to feed about six pounds of APFI pellets per hour into burn pot 120, had a carbon monoxide content, by volume, of about 0.01–0.02%, with the carbon monoxide content never going above 0.04%. In addition, the carbon dioxide content, by volume, of the exhaust gases emitted from the stove averaged about 10%, and ranged between 9% and 12%. Also, the combustion efficiency of stove 20, when operated so that its CO output is in the 0.01–0.02% range was about 90–98%. Furthermore, the overall efficiency of stove 20 was about 70%, with higher overall efficiency being achieved at intermediate feed rates, e.g., 2–5 pounds of APFI pellets per hour. This high combustion level and low emissions output was achieved without the use of a fan system for urging combustion air into burn pot 120 or for extracting exhaust gases from stove 20.

The ability to achieve such a high rate of combustion and low rate of emissions without a fan system for introducing combustion air into or extracting exhaust gases from heating device 20 is highly advantageous from both an environmental and a cost standpoint. A pellet burning stove built and operated in accordance with the teachings of the present invention will burn sufficiently cleanly to satisfy all current federal and state air pollution laws. As to cost, by avoiding the need for a separate fan system for adding air to or withdrawing gases from stove 20, the latter may be sold at the retail level for about $200–$300 less than pellet burning stoves incorporating fan systems for introducing combustion air or extracting exhaust gases.

Since certain changes may be made in the above device without departing from the scope of the invention here involved, it is intended that all matter contained in the above description or shown in the accompanying drawings shall be interpreted in an illustrative and not in a limiting sense.

The embodiments of the invention in which an exclusive property or privilege is claimed are defined as follows:

1. A pellet burning heating device designed to be coupled with a chimney having a predetermined natural draft, the device comprising:

a housing having a combustion chamber, said housing having a first aperture through which exhaust gases may escape from said combustion chamber, said first aperture being coupleable with the chimney, and a second aperture through which combustion gases may enter said combustion chamber;

a burn pot having an interior for supporting a plurality of pellets during combustion thereof, said burn pot being attached to said housing so that said interior is in communication with said combustion chamber via said second aperture;

feed means for dispensing pellets into said interior of said burn pot at a selected rate; and combustion air intake means coupled with said burn pot for coupling said interior of said burn pot with an atmosphere surrounding said housing so as to permit combustion air to flow into said interior solely by natural convection and for controlling the flow of combustion air into said interior solely by natural convection so as to permit pellets positioned in said interior to burn in a manner such that exhaust gases generated by such burning and withdrawn from said combustion chamber solely by the natural draft of a chimney coupled with said first aperture of said housing have a CO content of 0.04% or less.

2. A device according to claim 1, wherein said feed means is designed to feed pellets into said interior at a predetermined rate selected such that pellets burning in said burn pot are maintained at a predetermined level, further wherein said burn pot comprises a bottom wall and a sidewall, further wherein said combustion air intake means comprises (a) a first plurality of apertures extending through said bottom wall and that portion of said sidewall positioned below said predetermined level in said burn pot, and (b) a second plurality of apertures extending through that portion of said sidewall positioned above said predetermined level in said burn pot.

3. A device according to claim 2, wherein said first and second plurality of apertures have a size and number selected so that the total cross-sectional area of said first plurality of apertures is less than or about equal to the total cross-sectional area of said second plurality of apertures.

4. A device according to claim 3, wherein said total cross-sectional area of said first plurality of apertures is about equal to said total cross-sectional area of said second plurality of apertures.

5. A device according to claim 4, wherein each of said apertures has a diameter of about 0.125 inch, and said first and second plurality of apertures together number about 262.

6. A device according to claim 2, wherein said first and second plurality of apertures have a size and number selected so that the total cross-sectional area of said second plurality of apertures ranges from 95–110% of the total cross-sectional area of said first plurality of apertures.

7. A device according to claim 2, wherein said first and second plurality of apertures have a size and number selected based on the draft of the chimney with which the device is to be coupled so as to optimize combustion efficiency of the device when said feed means is operated at a predetermined rate.

8. A device according to claim 2, wherein said combustion air intake means is additionally designed to control the flow of combustion air flowing into said interior solely by natural convection so as to ensure the device operates at a combustion efficiency ranging from about 90–98% when said feed means is operated at a predetermined rate.

9. A device according to claim 1, wherein said housing comprises a floor, said second aperture extends through said floor, and said burn pot is attached to said housing so as to be positioned below said floor, further wherein said feed means is positioned so as to dispense pellets through said second aperture in said floor and into said interior of said burn pot.

10. A device according to claim 1, further comprising an enclosed chamber surrounding at least a portion of said housing, and fan means for drawing air into and exhausting air from said chamber.

11. A device according to claim 1, wherein said housing further comprises:

an opening mounted in said opening so as to permit viewing of said combustion chamber; and air wash means for providing a wash of relatively cool air over an inner surface of said window so as to reduce the tendency of carbon deposits to build up on said inner surface.

12. A pellet burning stove designed to be coupled with a chimney having a predetermined draft, the stove comprising:

a combustion chamber having an inlet through which combustion air may be introduced into said chamber and an outlet through which exhaust gases may be removed from said combustion chamber;

a burn pot having an interior for supporting a quantity of pellets during the combustion thereof, said interior having a predetermined pellet level, said burn pot comprising a first plurality of apertures positioned on one side of said pellet level through which primary combustion air may be introduced into said interior and a second plurality of apertures positioned on an opposite side of said pellet level through which secondary combustion air may be introduced into said interior, said burn pot being coupled with said combustion chamber via said inlet in said combustion chamber so that said primary and secondary combustion air may be introduced into said interior through said first and second plurality of apertures solely by natural convection and pass through said inlet into said combustion chamber;

a pellet feed assembly for feeding pellets into said interior of said burn pot so that said quantity of pellets supported in said interior may be maintained at substantially said pellet level; and wherein the number and cross-sectional area of said first and second plurality of apertures are selected so that even when said primary and secondary combustion air is introduced into said interior solely by natural convection and exhaust gases generated as a consequence of the combustion of said quantity of pellets in said interior of said burn pot are withdrawn solely by the draft of the chimney coupled with said combustion chamber, said exhaust gases will have a concentration of carbon monoxide, by volume, of no more than 0.04% when said quantity of pellets is maintained at substantially said pellet level.

13. A stove according to claim 12, wherein the total cross-sectional area of said first plurality of apertures is substantially equal to the total cross-sectional area of said second plurality of apertures.

14. A method of operating a pellet burning heating device having a combustion chamber, a burn pot having an interior for supporting pellets during the combustion process, and feed means for feeding pellets into the interior of the burn pot at a selected rate, the method comprising the steps of:

(a) coupling the combustion chamber with a chimney having a predetermined draft;

(b) operating the feed means so that pellets are delivered to, and maintained at a predetermined level in, the interior of the burn pot;

(c) continuously introducing, solely by natural convection, a first volume of combustion air into the interior of the burn pot on one side of said predetermined level so as to support combustion of pellets in the interior of the burn pot;

(d) continuously introducing, solely by natural convection, a second volume of combustion air into the interior of the burn pot on an opposite side of said predetermined level so as to support combustion of gases created as a consequence of combustion of pellets in the interior of the burn pot, wherein said second volume of combustion air is about 3.9–30 times greater than said first volume of combustion air; and (e) wherein the volume of combustion air introduced in steps c and d is such that exhaust gases discharged from the combustion chamber have a carbon monoxide concentration, by volume, of 0.04% or less.

15. A method according to claim 14, further comprising the step of withdrawing exhaust gases from the combustion chamber solely with the draft of the chimney coupled with the stove.

16. A method according to claim 14, wherein said second volume of air is about four times greater than said first volume of air.

17. A method according to claim 14, wherein said first and second volumes of air are selected such that said device has a combustion efficiency of about 90–98%.

* * * * *